US012201180B2

(12) United States Patent
Cheney et al.

(10) Patent No.: US 12,201,180 B2
(45) Date of Patent: Jan. 21, 2025

(54) RAPID-ENTRY FOOTWEAR HAVING ROTATABLE STRAPS

(71) Applicant: FAST IP, LLC, Lindon, UT (US)

(72) Inventors: Craig Cheney, Lindon, UT (US); Aislynn Edwards, Schenectady, NY (US)

(73) Assignee: FAST IP, LLC, Lindon, UT (US)

( * ) Notice: Subject to any disclaimer, the term of this patent is extended or adjusted under 35 U.S.C. 154(b) by 0 days.

(21) Appl. No.: 17/871,787

(22) Filed: Jul. 22, 2022

(65) Prior Publication Data

US 2022/0361627 A1 Nov. 17, 2022

Related U.S. Application Data

(63) Continuation of application No. PCT/US2021/015572, filed on Jan. 28, 2021.

(60) Provisional application No. 62/966,937, filed on Jan. 28, 2020.

(51) Int. Cl.
*A43B 11/00* (2006.01)

(52) U.S. Cl.
CPC ..... *A43B 11/00* (2013.01)

(58) Field of Classification Search
CPC ..... A43B 11/00
See application file for complete search history.

(56) References Cited

U.S. PATENT DOCUMENTS

| | | | |
|---|---|---|---|
| 112,439 | A | 3/1871 | Francis |
| 287,312 | A | 10/1883 | Packard |
| 736,156 | A | 8/1903 | Roberts |
| 808,948 | A | 1/1906 | Roberts et al. |
| 827,330 | A | 7/1906 | Tillson |
| 863,549 | A | 8/1907 | Metz |
| 881,153 | A | 3/1908 | Rickert |
| 923,860 | A | 6/1909 | Kroell |
| 921,461 | A | 9/1909 | Rickert |
| 1,081,678 | A | 12/1913 | Langerak |
| 1,116,462 | A | 11/1914 | Moran |
| 1,266,620 | A | 5/1918 | Peabody |
| 1,464,342 | A | 8/1923 | Rothacher |
| 1,494,236 | A | 5/1924 | Greathouse |
| 1,686,175 | A | 10/1928 | Read |
| 1,926,818 | A | 9/1933 | Ratcliff |
| 2,069,752 | A | 8/1935 | Dorr |
| 2,083,390 | A | 6/1937 | Murena |

(Continued)

FOREIGN PATENT DOCUMENTS

| | | |
|---|---|---|
| CN | 2438353 | 7/2001 |
| CN | 1403041 | 3/2003 |

(Continued)

OTHER PUBLICATIONS

U.S. Appl. No. 62/186,148, filed Jun. 29, 2015, Zahabian.

(Continued)

*Primary Examiner* — Ted Kavanaugh

(57) ABSTRACT

A rapid-entry shoe comprising a forward strap and a rearward strap configured to resiliently pivot relative to the other and/or configured to rotate relative to the rapid-entry shoe. The forward strap and the rearward strap are generally further apart from one another when the rapid-entry shoe is in an open configuration to facilitate reception of a foot of an individual donning the rapid-entry shoe.

16 Claims, 9 Drawing Sheets

(56) References Cited

U.S. PATENT DOCUMENTS

| | | | | |
|---|---|---|---|---|
| 2,118,019 | A | 5/1938 | Benjafield | |
| 2,266,732 | A | 4/1940 | Babinchak | |
| 2,297,594 | A | 9/1942 | Weinstat | |
| 2,368,514 | A | 1/1945 | Baehr | |
| 2,450,250 | A | 3/1945 | Napton | |
| 2,452,502 | A | 4/1945 | Tarbox | |
| 2,693,039 | A | 11/1954 | Balut | |
| 2,736,110 | A | 2/1956 | Hardimon | |
| 2,763,071 | A | 9/1956 | Kingsley | |
| 2,829,448 | A * | 4/1958 | Minera | A43B 11/00 36/58.5 |
| 2,920,402 | A | 1/1960 | Minera | |
| 3,000,116 | A | 9/1961 | Ally | |
| 3,014,288 | A | 12/1961 | Evans et al. | |
| 3,040,454 | A | 6/1962 | Topper et al. | |
| 3,097,438 | A | 7/1963 | Evans | |
| 3,146,535 | A | 9/1964 | Owings | |
| 3,192,651 | A | 7/1965 | Smith | |
| 3,373,512 | A | 3/1968 | Jacobson | |
| 3,643,350 | A | 2/1972 | Paoletta et al. | |
| 3,798,802 | A | 3/1974 | Saunders | |
| 4,489,509 | A | 12/1984 | Libit | |
| 4,590,690 | A | 5/1986 | Pfander | |
| 4,596,080 | A | 6/1986 | Benoit et al. | |
| 4,805,321 | A | 2/1989 | Tonkel | |
| 4,811,502 | A | 3/1989 | Barret | |
| 4,924,605 | A | 5/1990 | Spademan | |
| 4,972,613 | A | 11/1990 | Loveder | |
| 4,979,319 | A | 12/1990 | Hayes | |
| 5,054,216 | A | 10/1991 | Lin | |
| 5,090,140 | A | 2/1992 | Sessa | |
| 5,127,170 | A | 7/1992 | Messina | |
| 5,174,050 | A | 12/1992 | Gabrielli | |
| 5,181,331 | A | 1/1993 | Berger | |
| 5,184,410 | A | 2/1993 | Hamilton | |
| 5,257,470 | A | 11/1993 | Auger et al. | |
| 5,259,126 | A | 11/1993 | Rosen | |
| 5,265,353 | A | 11/1993 | Marega et al. | |
| 5,282,327 | A | 2/1994 | Ogle | |
| 5,311,678 | A | 5/1994 | Spademan | |
| 5,341,583 | A | 8/1994 | Hallenbeck | |
| 5,351,583 | A | 10/1994 | Szymber et al. | |
| 5,353,526 | A | 10/1994 | Foley et al. | |
| 5,371,957 | A | 12/1994 | Gaudio | |
| 5,430,961 | A | 7/1995 | Faulconer et al. | |
| 5,467,537 | A | 11/1995 | Aveni et al. | |
| 5,481,814 | A | 1/1996 | Spencer | |
| 5,806,208 | A | 9/1998 | French | |
| 5,842,292 | A | 12/1998 | Siesel | |
| 5,846,063 | A | 12/1998 | Lakic | |
| 5,983,530 | A | 11/1999 | Chou | |
| 5,997,027 | A | 12/1999 | Jungkind | |
| 6,000,148 | A | 12/1999 | Cretinon | |
| 6,014,823 | A | 1/2000 | Lakic | |
| 6,125,555 | A | 10/2000 | Schenkel | |
| 6,128,837 | A | 10/2000 | Huang | |
| 6,170,173 | B1 | 1/2001 | Caston | |
| 6,189,239 | B1 | 2/2001 | Gasparovic et al. | |
| 6,290,559 | B1 | 9/2001 | Scott | |
| 6,321,466 | B1 | 11/2001 | Bordin et al. | |
| 6,360,454 | B1 | 3/2002 | Dachgruber | |
| 6,367,171 | B1 | 4/2002 | Burt | |
| 6,378,230 | B1 | 4/2002 | Rotem et al. | |
| 6,470,537 | B1 | 10/2002 | Schallenkamp | |
| 6,643,954 | B2 | 11/2003 | Voswinkel | |
| 6,671,980 | B1 | 1/2004 | Liu | |
| 6,684,533 | B1 | 2/2004 | Su | |
| 6,839,985 | B2 | 1/2005 | Bettiol | |
| 6,877,252 | B2 | 4/2005 | Wilkinson | |
| 6,922,917 | B2 | 8/2005 | Kerns | |
| 6,925,732 | B1 | 8/2005 | Clarke | |
| 6,938,361 | B2 | 9/2005 | Su | |
| 7,059,068 | B2 | 6/2006 | Magallanes et al. | |
| 7,103,994 | B2 | 9/2006 | Johnson | |
| 7,178,270 | B2 | 2/2007 | Hurd et al. | |
| 7,225,563 | B2 | 6/2007 | Chen | |
| 7,439,837 | B2 | 10/2008 | McDonald | |
| D583,956 | S | 12/2008 | Chang et al. | |
| 7,661,205 | B2 | 2/2010 | Johnson | |
| 7,685,747 | B1 | 3/2010 | Gasparovic et al. | |
| 7,757,414 | B2 | 7/2010 | Tonkel | |
| 7,793,438 | B1 | 9/2010 | Busse et al. | |
| 7,823,299 | B1 * | 11/2010 | Brigham | A43B 3/24 36/11.5 |
| 7,975,403 | B2 | 7/2011 | Mosher | |
| D648,512 | S | 11/2011 | Schlageter | |
| 8,065,819 | B2 | 11/2011 | Kaufman | |
| 8,087,188 | B2 | 1/2012 | Labbe | |
| 8,161,669 | B2 | 4/2012 | Keating | |
| 8,225,535 | B2 | 7/2012 | Dillenbeck | |
| 8,302,329 | B2 | 11/2012 | Hurd et al. | |
| 8,333,021 | B2 | 12/2012 | Johnson | |
| 8,499,474 | B2 | 8/2013 | Kaufman | |
| 8,745,901 | B2 | 6/2014 | Toraya | |
| 8,769,845 | B2 | 7/2014 | Lin | |
| 9,119,441 | B2 | 9/2015 | Frappier | |
| 9,314,067 | B2 | 4/2016 | Bock | |
| 9,351,532 | B2 | 5/2016 | Mokos | |
| 9,615,624 | B2 | 4/2017 | Kilgore et al. | |
| 9,629,416 | B2 | 4/2017 | Rackiewicz et al. | |
| 9,635,905 | B2 | 5/2017 | Dekovic | |
| 9,675,132 | B2 | 6/2017 | Marshall | |
| 9,717,304 | B2 | 8/2017 | Bernhard et al. | |
| 9,820,527 | B2 | 11/2017 | Pratt et al. | |
| 9,877,542 | B2 | 1/2018 | Pratt | |
| 9,999,278 | B2 | 6/2018 | Feinstein | |
| 10,306,947 | B2 | 6/2019 | Pratt et al. | |
| 10,327,515 | B2 | 6/2019 | Peyton et al. | |
| D854,303 | S | 7/2019 | Flanagan et al. | |
| 10,455,898 | B1 | 10/2019 | Orand et al. | |
| 10,499,707 | B2 | 12/2019 | Hobson et al. | |
| 10,506,842 | B2 | 12/2019 | Pratt et al. | |
| 10,537,154 | B2 | 1/2020 | Smith et al. | |
| 10,568,382 | B2 | 2/2020 | Hatfield et al. | |
| 10,609,981 | B1 | 4/2020 | Phinney | |
| 10,617,174 | B1 | 4/2020 | Hopkins et al. | |
| 10,638,810 | B1 | 5/2020 | Cheney et al. | |
| 10,653,209 | B2 | 5/2020 | Pratt et al. | |
| 10,660,401 | B1 | 5/2020 | Pratt et al. | |
| 10,765,167 | B2 | 9/2020 | Azoulay et al. | |
| 10,791,796 | B1 | 10/2020 | Baker | |
| 10,813,405 | B2 | 10/2020 | Pratt | |
| 10,905,192 | B1 | 2/2021 | Cheney | |
| 10,912,348 | B2 | 2/2021 | Owings et al. | |
| 10,973,278 | B2 | 4/2021 | Raia | |
| 11,000,091 | B1 | 5/2021 | Kyle | |
| 11,140,941 | B2 | 10/2021 | Xanthos et al. | |
| 11,154,113 | B2 | 10/2021 | Hatfield et al. | |
| 11,172,727 | B2 | 11/2021 | Hatfield et al. | |
| 11,191,320 | B2 | 12/2021 | Happen | |
| 11,213,098 | B2 | 1/2022 | Beers et al. | |
| 11,234,482 | B2 | 2/2022 | Roser | |
| D948,190 | S | 4/2022 | Jury | |
| D948,191 | S | 4/2022 | Holmes | |
| D949,540 | S | 4/2022 | Jury | |
| D949,544 | S | 4/2022 | Witherow | |
| D955,732 | S | 6/2022 | Kelley | |
| 11,633,005 | B2 | 4/2023 | Pratt et al. | |
| 11,633,006 | B2 | 4/2023 | Pratt et al. | |
| 11,633,016 | B2 | 4/2023 | Orand et al. | |
| 11,659,886 | B2 | 5/2023 | Cheney et al. | |
| 11,700,916 | B2 | 7/2023 | Kilgore et al. | |
| 11,707,113 | B2 | 7/2023 | Hopkins et al. | |
| D993,601 | S | 8/2023 | Wang et al. | |
| 11,737,511 | B2 | 8/2023 | Cheney et al. | |
| 11,744,319 | B2 | 9/2023 | Farina | |
| 2001/0001350 | A1 | 5/2001 | Aguerre | |
| 2002/0053147 | A1 | 5/2002 | Borsoi et al. | |
| 2002/0066213 | A1 | 6/2002 | Wells | |
| 2002/0095823 | A1 | 7/2002 | Laio et al. | |
| 2002/0144434 | A1 | 10/2002 | Farys | |
| 2002/0174568 | A1 | 11/2002 | Neiley | |
| 2003/0106244 | A1 | 6/2003 | Miller et al. | |
| 2004/0003517 | A1 | 1/2004 | Marvin et al. | |

(56) References Cited

U.S. PATENT DOCUMENTS

2004/0088890 A1 5/2004 Matis et al.
2004/0111921 A1 6/2004 Lenormand
2005/0022428 A1 2/2005 Anderson
2005/0034328 A1 2/2005 Geer
2005/0039348 A1 2/2005 Raluy et al.
2005/0066543 A1 3/2005 Rosen et al.
2005/0076540 A1 4/2005 Su
2005/0198867 A1 9/2005 Labbe
2005/0241189 A1 11/2005 Elkington et al.
2007/0074425 A1 4/2007 Leong
2007/0180730 A1 8/2007 Greene et al.
2007/0209234 A1 9/2007 Chou
2007/0256329 A1 11/2007 Antonelli et al.
2007/0271822 A1 11/2007 Meschter
2007/0277394 A1 12/2007 Hansen et al.
2008/0086911 A1 4/2008 Labbe
2008/0189984 A1 8/2008 Januszewski et al.
2008/0276492 A1 11/2008 Burnett
2008/0307673 A1 12/2008 Johnson
2008/0313929 A1 12/2008 Hoyt
2009/0090026 A1 4/2009 Mosher
2010/0037483 A1 2/2010 Meschter et al.
2010/0095494 A1 4/2010 Martin
2010/0095554 A1 4/2010 Gillespie
2010/0251572 A1 10/2010 Baudouin et al.
2011/0016751 A1* 1/2011 Somerville ..... A43B 3/122 36/105
2011/0146106 A1 6/2011 Kaufman
2011/0185592 A1 8/2011 Nishiwaki et al.
2011/0214313 A1 9/2011 James et al.
2011/0239489 A1 10/2011 Iuchi et al.
2011/0277350 A1 11/2011 Huynh
2012/0055044 A1 3/2012 Dojan et al.
2012/0060395 A1 3/2012 Blevens et al.
2012/0151799 A1 6/2012 Weinreb
2012/0167413 A1 7/2012 Marvin et al.
2012/0216429 A1 8/2012 Bastida et al.
2012/0317839 A1* 12/2012 Pratt ..... A43B 21/42 36/105
2013/0160328 A1 6/2013 Hatfield et al.
2013/0185959 A1 7/2013 Coleman
2013/0219747 A1 8/2013 Lederer
2013/0312285 A1 11/2013 Sharma et al.
2014/0013624 A1 1/2014 Stockbridge et al.
2014/0090274 A1 4/2014 Arquilla
2014/0101975 A1 4/2014 Ueda
2014/0123516 A1 5/2014 Cressman et al.
2014/0173932 A1 6/2014 Bell
2014/0189964 A1 7/2014 Wen et al.
2014/0202044 A1 7/2014 Adami et al.
2014/0259781 A1 9/2014 Sakai
2014/0298687 A1 10/2014 Flinterman et al.
2014/0305005 A1 10/2014 Yeh
2014/0373396 A1 12/2014 Chang
2015/0013184 A1 1/2015 Beers
2015/0013189 A1 1/2015 Hanak et al.
2015/0020416 A1 1/2015 Wiens
2015/0047222 A1 2/2015 Rushbrook
2015/0047223 A1 2/2015 Flinterman et al.
2015/0165338 A1 6/2015 Choe
2015/0216252 A1 8/2015 Wiens
2015/0305432 A1 10/2015 Wiens
2015/0305442 A1 10/2015 Ravindran
2016/0007674 A1 1/2016 Labonte et al.
2016/0128424 A1 5/2016 Connell et al.
2016/0128429 A1 5/2016 Hatfield et al.
2016/0262492 A1 9/2016 Fujita et al.
2016/0302530 A1 10/2016 Smith et al.
2016/0374427 A1 12/2016 Zahabian
2017/0013915 A1 1/2017 Caston, Jr.
2017/0035148 A1 2/2017 Marvin et al.
2017/0127755 A1 5/2017 Bunnell et al.
2017/0215525 A1 8/2017 Labbe
2017/0265562 A1 9/2017 Mullen
2017/0303632 A1 10/2017 Pratt
2017/0360143 A1 12/2017 Pratt
2017/0360151 A1 12/2017 Pratt
2018/0110287 A1 4/2018 Hopkins et al.
2018/0110292 A1 4/2018 Beers et al.
2018/0199659 A1 7/2018 Lintaman
2018/0235314 A1 8/2018 Farage
2018/0255865 A1 9/2018 Hsu
2018/0263332 A1 9/2018 Bruno
2018/0289109 A1 10/2018 Beers et al.
2018/0295942 A1 10/2018 Drake
2018/0338572 A1 11/2018 Cross et al.
2018/0343968 A1 12/2018 James et al.
2019/0053571 A1 2/2019 Bjornson et al.
2019/0116916 A1 4/2019 Burch
2019/0281920 A1 9/2019 Ito et al.
2019/0289960 A1 9/2019 Loveder
2019/0297999 A1 10/2019 Nakaya et al.
2019/0307208 A1 10/2019 Corcoran-Tadd et al.
2019/0365029 A1 12/2019 Cross et al.
2019/0366667 A1 12/2019 Cross et al.
2020/0015544 A1 1/2020 Pratt
2020/0037703 A1 2/2020 Twist
2020/0046066 A1 2/2020 Difrancisco
2020/0068991 A1 3/2020 Steere et al.
2020/0085136 A1 3/2020 Pratt et al.
2020/0113274 A1 4/2020 Butler
2020/0187590 A1 6/2020 Hopkins et al.
2020/0196703 A1 6/2020 Hopkins
2020/0196787 A1 6/2020 Dament et al.
2020/0205511 A1 7/2020 Hopkins et al.
2020/0205512 A1 7/2020 Blanche et al.
2020/0205516 A1 7/2020 Kilgore
2020/0205518 A1 7/2020 Hopkins et al.
2020/0205520 A1 7/2020 Kilgore
2020/0245797 A1 8/2020 Kim
2020/0253333 A1 8/2020 Kilgore et al.
2020/0305552 A1 10/2020 Cheney et al.
2020/0323308 A1 10/2020 Dubuisson
2020/0375319 A1 12/2020 Yang
2020/0383424 A1 12/2020 Hughes
2021/0059351 A1 3/2021 Piacentini
2021/0068493 A1 3/2021 Pratt et al.
2021/0068494 A1 3/2021 Zahabian
2021/0068498 A1 3/2021 Cheney et al.
2021/0106094 A1 4/2021 Cheney
2021/0112911 A1 4/2021 Pratt et al.
2021/0112914 A1 4/2021 Cheney
2021/0112916 A1 4/2021 Schulten
2021/0127788 A1 5/2021 Li
2021/0145114 A1 5/2021 Kyle
2021/0169177 A1 6/2021 Yang
2021/0186146 A1 6/2021 Erwin
2021/0204642 A1 7/2021 Kyle
2021/0204643 A1 7/2021 Kyle
2021/0204644 A1 7/2021 Kyle
2021/0204645 A1 7/2021 Pratt
2021/0227923 A1 7/2021 Love et al.
2021/0235811 A1 8/2021 Oh
2021/0282495 A1 9/2021 Davis et al.
2021/0321718 A1 10/2021 Chang
2021/0330033 A1 10/2021 Pratt et al.
2021/0337922 A1 11/2021 Cheney
2021/0345727 A1 11/2021 Raia
2022/0104582 A1 4/2022 Christensen et al.
2022/0132976 A1 5/2022 Bentz
2022/0142291 A1 5/2022 Cheney et al.
2022/0240625 A1 8/2022 Shin
2022/0287406 A1 9/2022 Cheney et al.
2022/0287407 A1 9/2022 Cheney et al.
2022/0354220 A1 11/2022 Cheney
2022/0369758 A1 11/2022 Pratt
2022/0378144 A1 12/2022 Pratt et al.
2022/0400810 A1 12/2022 Cheney et al.
2023/0030016 A1 2/2023 Pratt et al.
2023/0033366 A1 2/2023 Farina
2023/0035573 A1 2/2023 Bar
2023/0052916 A1 2/2023 Bar
2023/0055164 A1 2/2023 Cheney et al.
2023/0077572 A1 3/2023 Dean et al.

(56) References Cited

U.S. PATENT DOCUMENTS

| | | | |
|---|---|---|---|
| 2023/0081272 | A1 | 3/2023 | Pratt |
| 2023/0084256 | A1 | 3/2023 | Brilliant |
| 2023/0218033 | A1 | 7/2023 | Cheney |
| 2023/0225450 | A1 | 7/2023 | Cheney et al. |
| 2023/0263270 | A1 | 8/2023 | Jones |
| 2023/0276897 | A1 | 9/2023 | Cheney et al. |
| 2023/0284737 | A1 | 9/2023 | Bar |

FOREIGN PATENT DOCUMENTS

| | | | |
|---|---|---|---|
| CN | 201005111 | | 1/2008 |
| CN | 101991227 | A | 3/2011 |
| CN | 107467775 | A | 12/2017 |
| DE | 19534249 | | 3/1997 |
| DE | 19611797 | | 10/1997 |
| DE | 29809404 | | 8/1998 |
| DE | 10247163 | | 10/2002 |
| DE | 102004005288 | | 8/2005 |
| EP | 1059044 | | 12/2000 |
| EP | 1952715 | A1 | 8/2008 |
| EP | 3266327 | A1 | 1/2018 |
| FR | 3066679 | A1 | 11/2018 |
| GB | 2517399 | | 8/2013 |
| JP | 181910 | | 6/1989 |
| JP | 11-127907 | A | 5/1999 |
| JP | 2001149394 | | 6/2001 |
| JP | 2006055571 | | 3/2006 |
| JP | 2010-104416 | A | 5/2010 |
| JP | 2014-161721 | A | 9/2014 |
| KR | 10-2005-0095542 | A | 9/2005 |
| KR | 10-2009-0093548 | A | 9/2009 |
| KR | 10-2009-0130804 | A | 12/2009 |
| KR | 10-0936510 | B1 | 1/2010 |
| NL | 2000762 | C1 | 1/2009 |
| WO | 2007080205 | | 7/2007 |
| WO | 2009089572 | | 7/2009 |
| WO | 2009154350 | | 12/2009 |
| WO | 2017004135 | | 1/2017 |
| WO | 2018/230961 | A1 | 12/2018 |
| WO | 2019/215359 | A1 | 11/2019 |
| WO | 2020006490 | | 1/2020 |
| WO | 2020176653 | | 9/2020 |
| WO | 2021/162569 | A1 | 8/2021 |
| WO | 2022/221339 | A1 | 10/2022 |
| WO | 2023/049414 | A1 | 3/2023 |
| WO | 2023/064568 | A1 | 4/2023 |

OTHER PUBLICATIONS

Sneider, "Kizik Handsfree New York Shoe Review," https://the-gadgeteer.com/2018/06/27/kizik-handsfree-new-york-show-review/ (2018).

https://www.teva.com/kids-sandals/hurricane-drift/ 1102483C.html submitted herewith as of Jun. 13, 2019.

https://us.ecco.com/ecco-biom-fjuel-mens-outdoor-shoe-837594.html?dwvar_837594_color=00001 submitted herewith as of Jun. 1, 2016.

International Preliminary Report on Patentability received for PCT Patent Application No. PCT/US21/015572, mailed on Aug. 11, 2022, 7 pages.

International Search Report and Written Opinion dated Apr. 7 , 2021 in PCT International Patent Application No. PCT/US2021/15572.

* cited by examiner

RAPID-ENTRY FOOTWEAR HAVING ROTATABLE STRAPS

CROSS-REFERENCE TO RELATED APPLICATIONS

This application is a continuation of, claims priority to and the benefit of PCT Serial No. PCT/US21/15572 filed Jan. 28, 2021 and entitled "RAPID-ENTRY FOOTWEAR HAVING ROTATABLE STRAPS." PCT Serial No. PCT/US21/15572 claims the benefit of U.S. Provisional Patent Application No. 62/966,937, filed Jan. 28, 2020 and entitled "RAPID-ENTRY FOOTWEAR HAVING ROTATABLE STRAPS." All of the aforementioned applications are incorporated herein by reference in their entireties.

FIELD

The present disclosure relates to footwear, and more particularly to rapid-entry footwear.

BACKGROUND

Whether due to inconvenience or inability, donning and doffing of shoes, including tying or otherwise securing the same, may be undesirable and/or present difficulties to some individuals. The present disclosure addresses this need.

SUMMARY

Disclosed herein, in various embodiments, is rapid-entry footwear having rotatable straps.

A rapid-entry shoe, in accordance with example embodiments of the present disclosure, comprises a forward strap, a rearward strap and a sole portion. In example embodiments, the forward strap is coupled to the rearward strap on a medial side of the rapid-entry shoe at a medial intersection, and the forward strap is coupled to the rearward strap on a lateral side of the rapid-entry shoe at a lateral intersection. In example embodiments, the forward strap extends forward between the medial intersection and the lateral intersection, and the rearward strap extends rearward between the medial intersection and the lateral intersection.

In example embodiments, the forward strap and the rearward strap are configured to resiliently pivot relative to the other from the medial intersection and/or the lateral intersection. In example embodiments, the forward strap and the rearward strap are configured to rotate relative to the rapid-entry shoe about an axis of rotation.

In example embodiments, the rapid-entry shoe is biased from an open configuration toward a closed configuration, the forward strap and the rearward strap being generally further apart from one another when the rapid-entry shoe is in the open configuration to facilitate reception of a foot of an individual donning the rapid-entry shoe.

In example embodiments of the present disclosure, the forward strap and the rearward strap are coupled to each other with a resilient member. In other example embodiments, the forward strap and the rearward strap are a unitary structure comprised of a resilient material. In still other example embodiments, the forward strap and the rearward strap are a unitary structure comprising a living hinge.

In example embodiments of the present disclosure, an upper of the rapid-entry shoe is coupled to the forward strap and/or the rearward strap.

In example embodiments of the present disclosure, the medial intersection and the lateral intersection are below an upper surface of the sole portion. In other example embodiments, the medial intersection and the lateral intersection are above an upper surface of the sole portion.

In example embodiments of the present disclosure, the axis of rotation is below an upper surface of the sole portion. In other example embodiments, the axis of rotation is above an upper surface of the sole portion.

BRIEF DESCRIPTION OF THE DRAWINGS

The accompanying drawings may provide a further understanding of example embodiments of the present disclosure and are incorporated in, and constitute a part of, this specification. In the accompanying drawings, only one rapid-entry shoe (either a left shoe or a right shoe) may be illustrated, however, it should be understood that in such instances, the illustrated shoe may be mirror-imaged so as to be the other shoe. The use of like reference numerals throughout the accompanying drawings is for convenience only, and should not be construed as implying that any of the illustrated embodiments are equivalent. The accompanying drawings are for purposes of illustration and not of limitation.

DETAILED DESCRIPTION

Figure 1A:
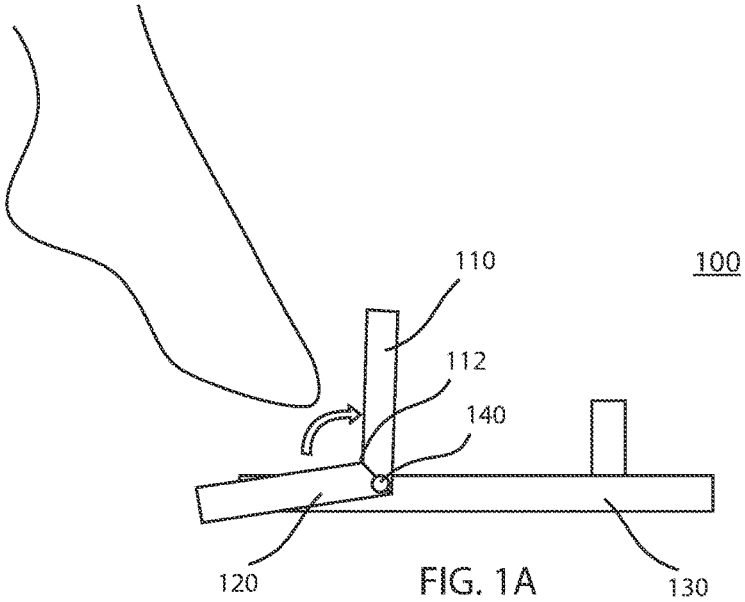
FIGS. 1A-1D illustrate a rapid-entry shoe having distinct straps, in accordance with an example embodiment.
Figure 1B:
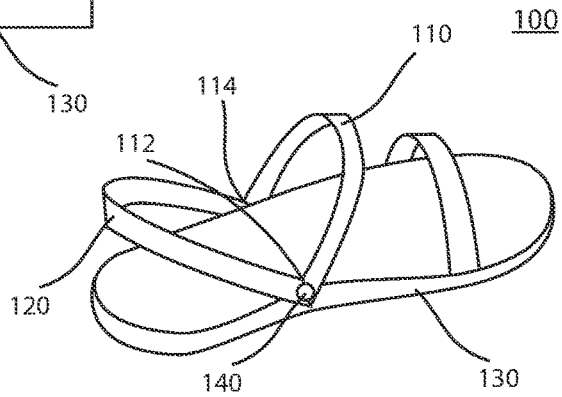

Example embodiments of the present disclosure are described in sufficient detail in this detailed description to enable persons having ordinary skill in the relevant art to practice the present disclosure, however, it should be understood that other embodiments may be realized and that mechanical and chemical changes may be made without departing from the spirit or scope of the present disclosure. Thus, this detailed description is for purposes of illustration and not of limitation.

For example, unless the context dictates otherwise, example embodiments described herein may be combined with other embodiments described herein. Similarly, references to "example embodiment," "example embodiments" and the like indicate that the embodiment(s) described may comprise a particular feature, structure, or characteristic, but every embodiment may not necessarily comprise the particular feature, structure, or characteristic. Moreover, such references may not necessarily refer to the same embodiment(s). Any reference to singular includes plural embodiments, and any reference to plural includes singular embodiments.

Any reference to coupled, connected, attached or the like may be temporary or permanent, removeable or not, non-integral or integral, partial or full, and may be facilitated by one or more of adhesives, stitches, hook and loop fasteners, buttons, clips, grommets, zippers and other means known in the art or hereinafter developed.

As used herein, the transitional term "comprising", which is synonymous with "including," "containing," or "characterized by," is inclusive or open-ended and does not exclude additional, unrecited elements or method steps. The transitional phrase "consisting of" excludes any element, step, or ingredient not specified in the claim. The transitional phrase "consisting essentially of" limits the scope of a claim to the specified materials or steps "and those that do not materially affect the basic and novel characteristic(s)" of the claimed invention.

No claim limitation is intended to invoke 35 U.S.C. 112(f) or pre-AIA 35 U.S.C. 112, sixth paragraph or the like unless it explicitly uses the term "means" and includes functional language.

In describing example embodiments of the rapid-entry footwear, certain directional terms may be used. By way of example, terms such as "right," "left," "medial," "lateral," "front," "back," "forward," "backward," "rearward," "top," "bottom," "upper," "lower," "up," "down," and the like may be used to describe example embodiments of the rapid-entry footwear. These terms should be given meaning according to the manner in which the rapid-entry footwear is most typically designed for use, with the rapid-entry footwear on a user's foot and with the user's shod foot disposed on or ready for placement on an underlying surface. Thus, these directions may be understood relative to the rapid-entry footwear in such use. Similarly, as the rapid-entry footwear is intended primarily for use as footwear, terms such as "inner," "inward," "outer," "outward," "innermost," "outermost," "inside," "outside," and the like should be understood in reference to the rapid-entry footwear's intended use, such that inner, inward, innermost, inside, and the like signify relatively closer to the user's foot, and outer, outward, outermost, outside, and the like signify relatively farther from the user's foot when the rapid-entry footwear is being used for its intended purpose. Notwithstanding the foregoing, if the foregoing definitional guidance is contradicted by an individual use herein of any of the foregoing terms, the term should be understood and read according to the definition that gives life and meaning to the particular instance of the term.

As used herein, a "rapid-entry shoe" refers to an athleisure shoe, a casual shoe, a formal shoe, a dress shoe, a heel, a sports/athletic shoe (e.g., a tennis shoe, a golf shoe, a bowling shoe, a running shoe, a basketball shoe, a soccer shoe, a ballet shoe, etc.), a walking shoe, a sandal, a boot, or other suitable type of shoe. Additionally, a rapid-entry shoe can be sized and configured to be worn by men, women, or children.

With reference to FIGS. 1A-1D, a rapid-entry shoe 100 in accordance with the present disclosure comprises a forward strap 110, a rearward strap 120 and a sole portion 130. Example embodiments of the present disclosure will be described with reference to both a forward strap 110 and a rearward strap 120, however, a single strap is also contemplated, as are additional straps.

As used herein, a "strap" of a rapid-entry shoe refers to a distinct strip of material or a portion of an upper. In example embodiments, a strap of the present disclosure is not merely a commonly-used upper material (e.g., canvas, leather, nylon), but is instead a material exhibiting sufficient rigidity for the purposes of the present disclosure, for example, a styrene-butadiene copolymer, polyvinyl chloride, urethane or another polymer material, thermoplastic rubber (TPR), silicone, styrene-ethylene/butylene-styrene (SEBS), nylon, acetal homopolymer/polyoxymethylene, aluminum, TPU, TPC-ET, polypropylene, acrylic resin, rubber, ABS, and polycarbonate. In general, a strap of the present disclosure can be comprised of a material exhibiting resilient deformability.

As used herein, a "sole portion" of a rapid-entry shoe refers to an outsole or portions thereof, a midsole or portions thereof, an insole or portions thereof, a wedge or portions thereof, or other suitable structure disposed between and/or adjacent to the foregoing parts of a rapid-entry shoe.

In some embodiments, one or both of the forward strap and the rearward strap can extend between, and be coupled to, medial and lateral sides of the sole portion. In other embodiments, one or both of the forward strap and the rearward strap can extend from one but not both of medial and lateral sides of the sole portion.

More broadly, in example embodiments, the forward strap 110 is coupled to the rearward strap 120 on a medial side of the rapid-entry shoe 100 at a medial intersection 112, and the forward strap 110 is coupled to the rearward strap 120 on a lateral side of the rapid-entry shoe 100 at a lateral intersection 114. In example embodiments, the forward strap 110 extends forward between the medial intersection 112 and the lateral intersection 114, and the rearward strap 120 extends rearward between the medial intersection 112 and the lateral intersection 114.

As used herein, a strap "intersection" refers to a location where a plurality of distinct straps merge with each other, whether being coupled, overlapping, being a unitary structure, or otherwise.

Figure 1C:
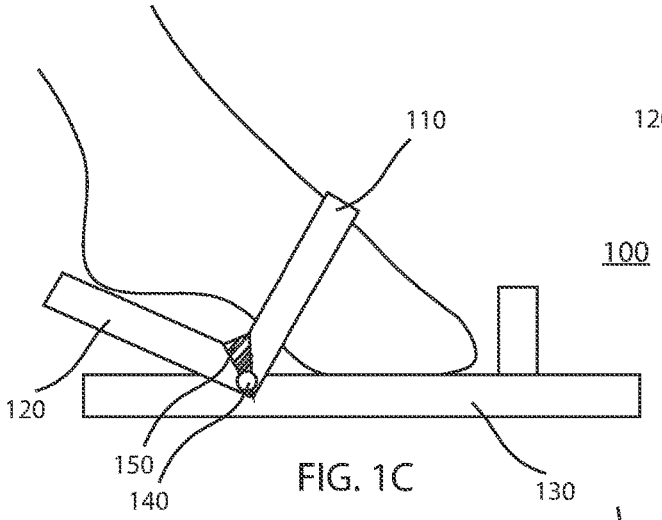
Figure 1D:
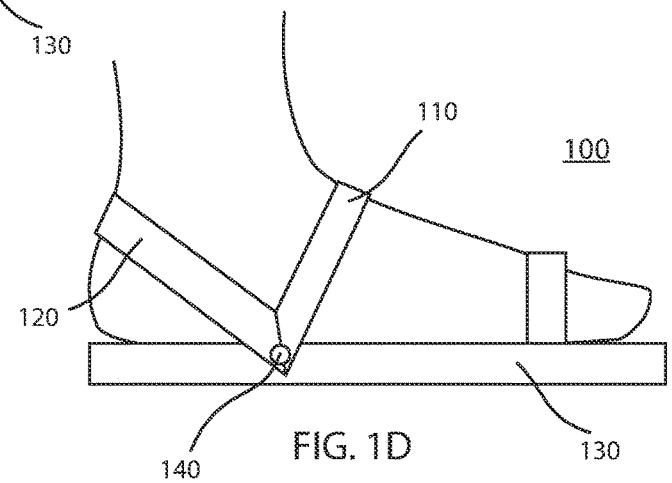
Figure 2A:
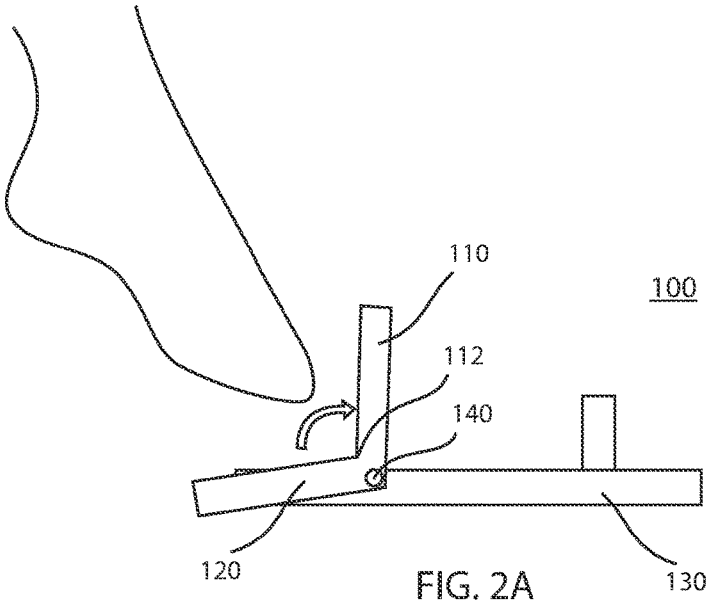
FIGS. 2A-2D illustrate a rapid-entry shoe having a unitary strap, in accordance with an example embodiment.
Figure 2B:
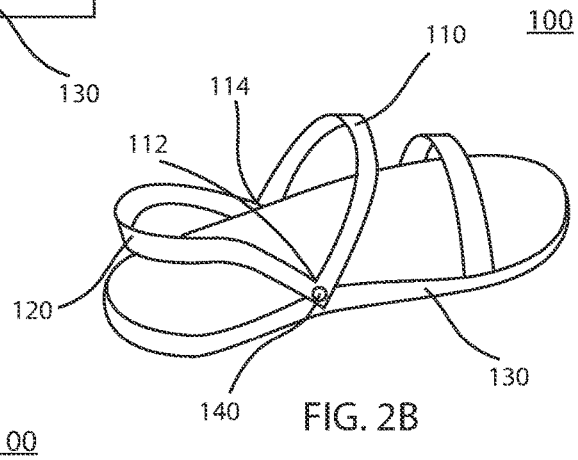
Figure 2C:
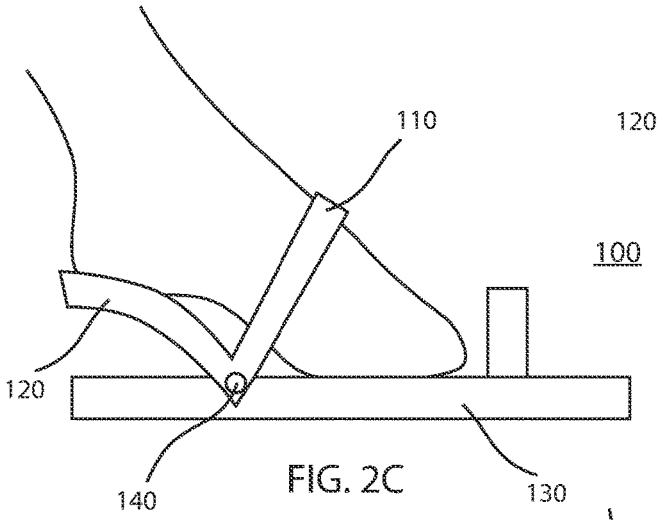
Figure 2D:
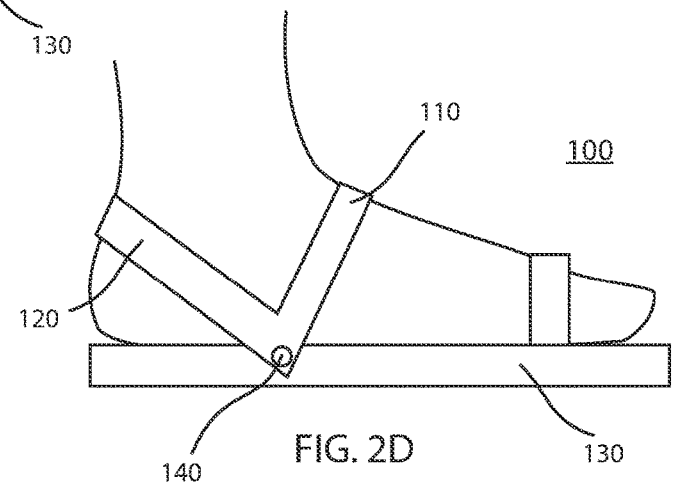

In various embodiments, the rapid-entry shoe has an open configuration in which an opening of the rapid-entry shoe is expanded to facilitate reception of a foot of an individual donning the rapid-entry shoe. In various embodiments, the rapid-entry shoe has a closed configuration in which the opening is unexpanded to retain a foot within the rapid-entry shoe. In the open configuration, the forward and rearward straps are generally further apart from one another, and the shoe 100 has a generally larger opening for receiving a user's foot, than in the closed configuration. In example embodiments, the rapid-entry shoe is biased toward the closed configuration. For the avoidance of doubt, example rapid-entry shoes in an open configuration are illustrated in FIGS. 1C, 2C and 3B, while example rapid-entry shoes in a closed configuration are illustrated in FIGS. 1D, 2D and 3C.

In this regard, in example embodiments, the forward strap 110 and the rearward strap 120 are configured to pivot (e.g., resiliently) relative to the other away from the medial intersection 112 and/or the lateral intersection 114.

Figure 6A:
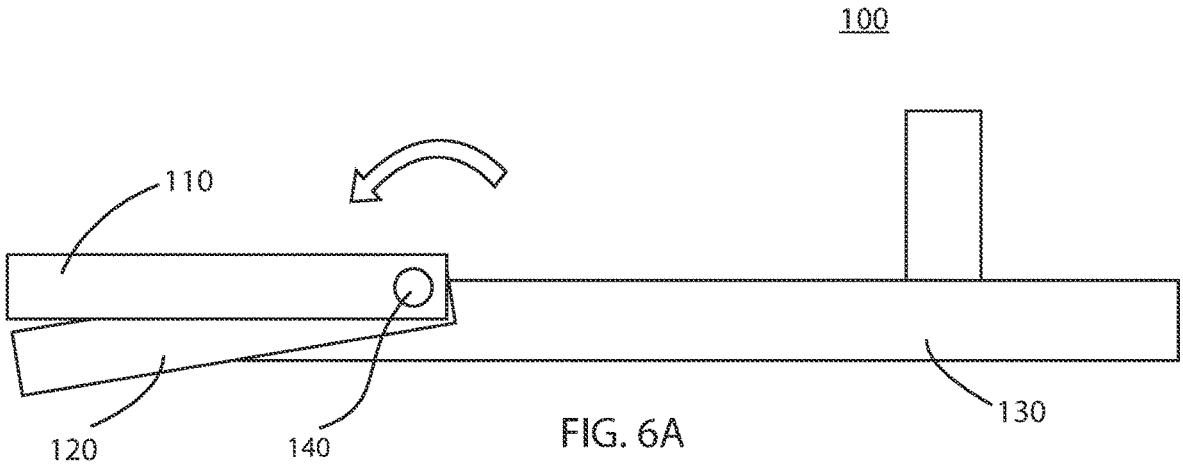
FIGS. 6A and 6B illustrate rotation of straps of a rapid-entry shoe, in accordance with an example embodiment.
Figure 6B:
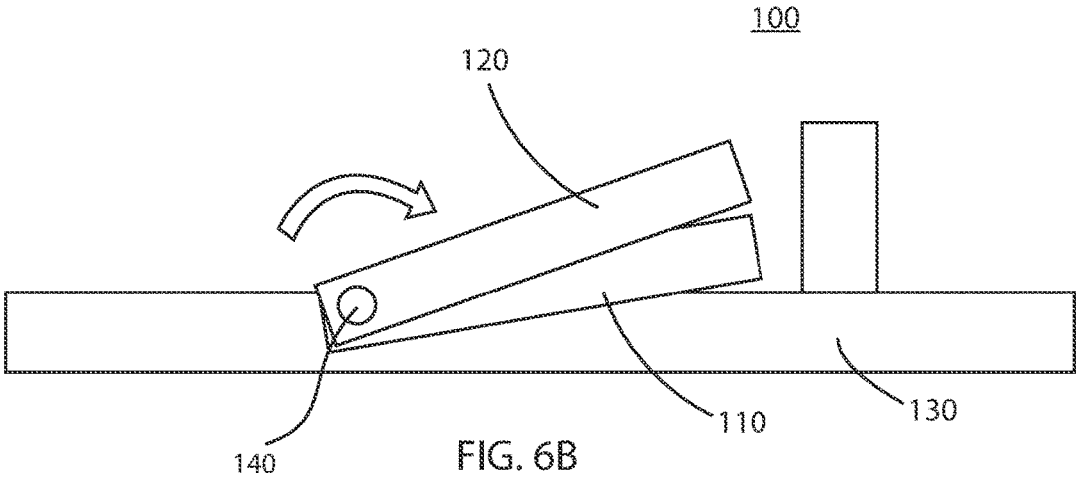

In some embodiments, and with momentary reference to FIGS. 6A and 6B, the forward strap 110 and the rearward strap 120 are directly coupled to each other at a strap intersection with a pin member (e.g., a pin or dowel), the pin member configured to permit the forward strap 110 and the rearward strap 120 to pivot relative to each other.

In other embodiments, and with continued reference to FIGS. 1A-1D, the forward strap 110 and the rearward strap 120 are indirectly coupled to each other at strap intersection 112 or 114 by a resilient member 150 (or other bridge member) configured to permit the forward strap 110 and the rearward strap 120 to pivot relative to each other, and also (in some but not all embodiments) configured to bias the forward strap 110 and the rearward strap 120 toward each another (e.g., from an open configuration toward a closed configuration). A resilient member 150 can be coupled to an end of a forward strap 110 or rearward strap 120. Alternatively, a resilient member 150 can be coupled to an inner or outer surface of a forward strap 110 or rearward strap 120. A pin member as described above can also be used in connection with a resilient member 150.

In example embodiments, an end of the forward strap 110 can comprise an angled edge corresponding to an angled edge of the rearward strap 120, wherein the angles are selected based on the desired opening for receiving a user's foot. For example, edges having a shallower angle would result in a smaller opening.

With reference to FIGS. 2A-2D, a forward strap and a rearward strap can be a unitary structure (e.g., formed from a single continuous piece, formed from a common mold) comprised of a resilient material (e.g., capable of resilient deformation). Thus, in example embodiments, instead of comprising a resilient member, or in addition to, one or both of the straps can themselves be resilient to be able to resiliently pivot relative to the other away from a strap intersection 112 or 114.

Figure 3A:
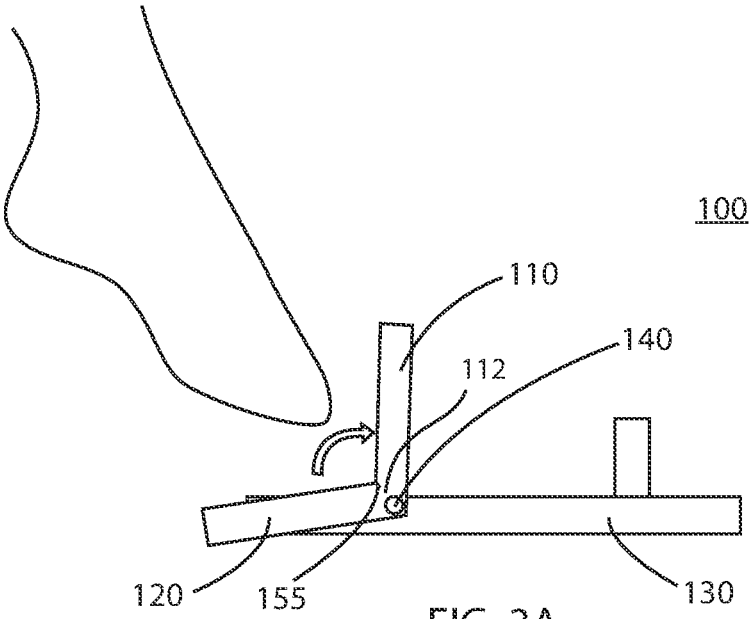
FIGS. 3A-3C illustrate a rapid-entry shoe having a living hinge, in accordance with an example embodiment.
Figure 3B:
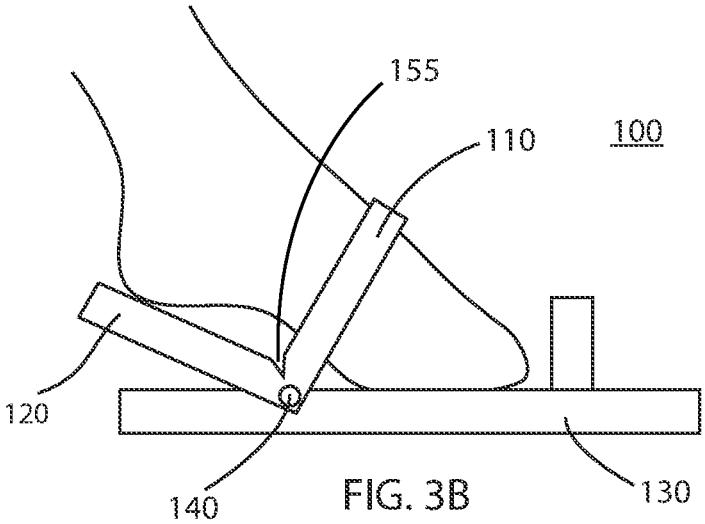
Figure 3C:
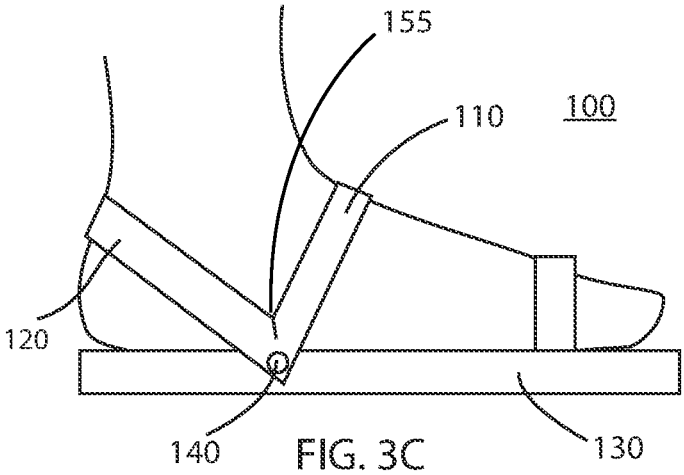
Figure 4A:
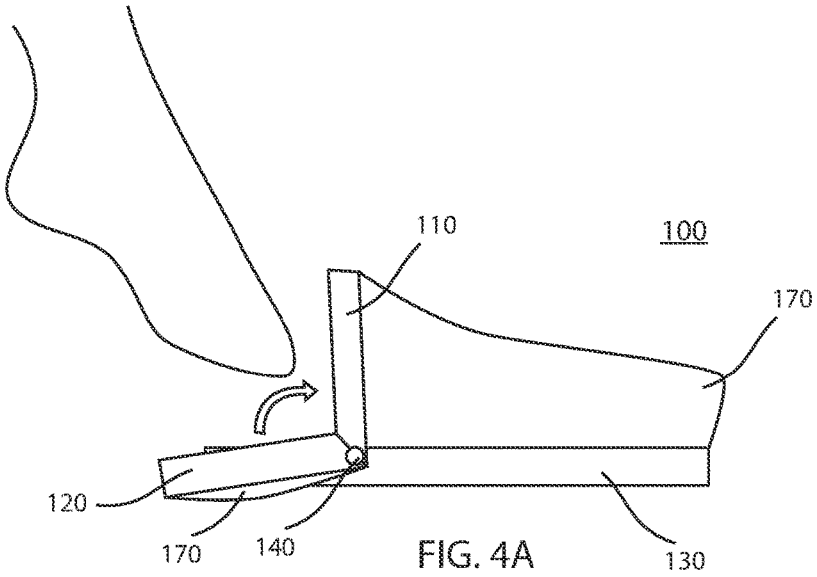
FIGS. 4A-4D illustrate a rapid-entry shoe comprising an upper, in accordance with an example embodiment.
Figure 4B:
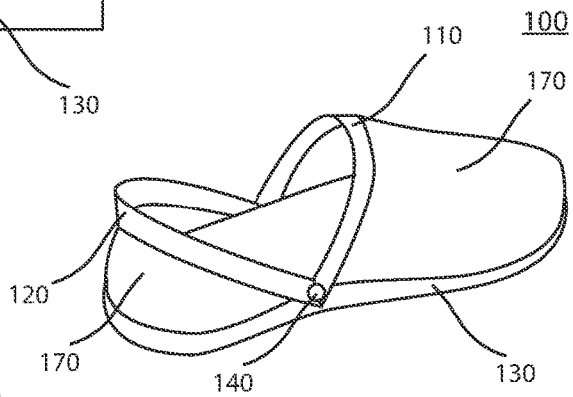
Figure 4C:
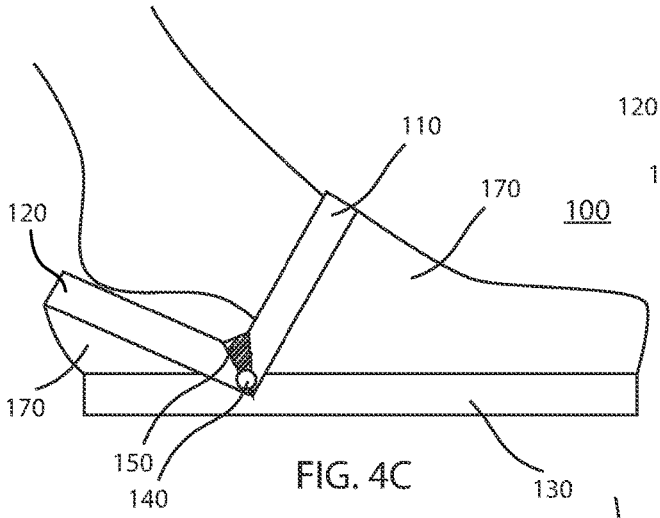
Figure 4D:
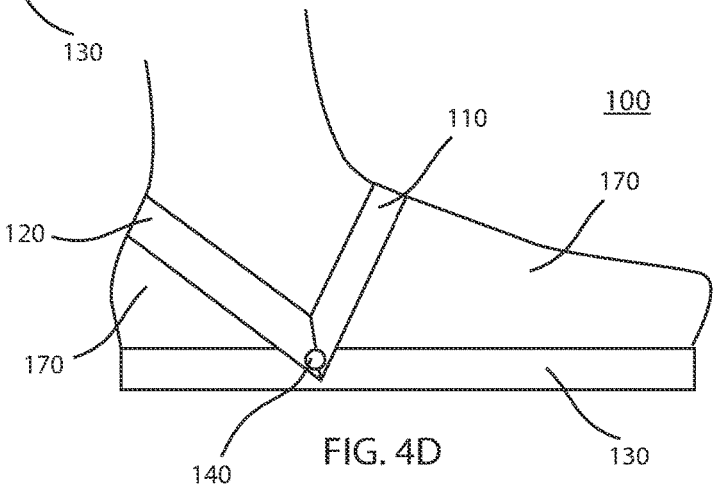

With reference to FIGS. 3A-3C, the forward strap 110 and the rearward strap 120 are a unitary structure comprising a living hinge 155 at a strap intersection 112 or 114. A living hinge can comprise a cut extending completely from one side of strap intersection 112 or 114, or a material or portion thereof weaker or thinner (e.g., scored or perforated) than an adjacent material or portion thereof. In such embodiments, the living hinge 155 can be configured to permit the forward strap 110 and the rearward strap 120 to resiliently pivot relative to each other away from a strap intersection 112 or 114.

With reference to FIGS. 4A-4D, one or both of a forward strap 110 and a rearward strap 120 can be coupled to (e.g., inside, outside, between layers), or comprised of, a portion (e.g., an edge) of an upper 170 (e.g., a closed-toe upper or a toe strap).

In connection with the foregoing embodiments, a forward strap 110 and a rearward strap 120 (or a strap intersection) can terminate at, or otherwise overlap or encompass, an axis of rotation 140, discussed below. For example, in some embodiments the forward strap 110 and/or the rearward strap 120 are coupled to each other and also to the sole portion 130 at an axis of rotation 140 with a pin member (e.g., a pin or dowel). In this regard, in some embodiments the forward strap 110 and/or the rearward strap 120 are configured to pivot relative to each other about the same axis about which the forward strap 110 and/or the rearward strap 120 are configured to rotate relative to the rapid-entry shoe 100 (e.g., a sole portion 130 of the rapid-entry shoe 100).

Figure 5A:
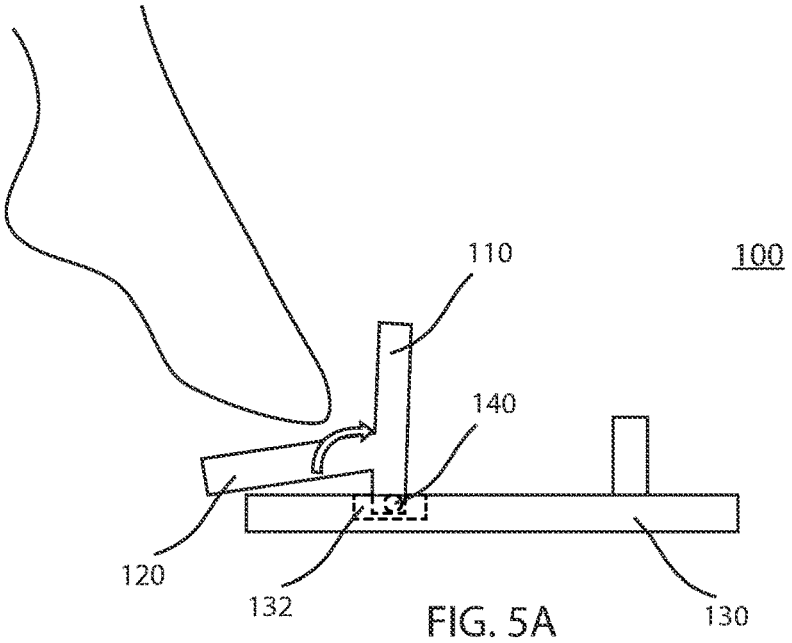
FIGS. 5A-5C illustrate a rapid-entry shoe having a strap intersection above an upper surface of a sole portion, in accordance with an example embodiment.
Figure 5B:
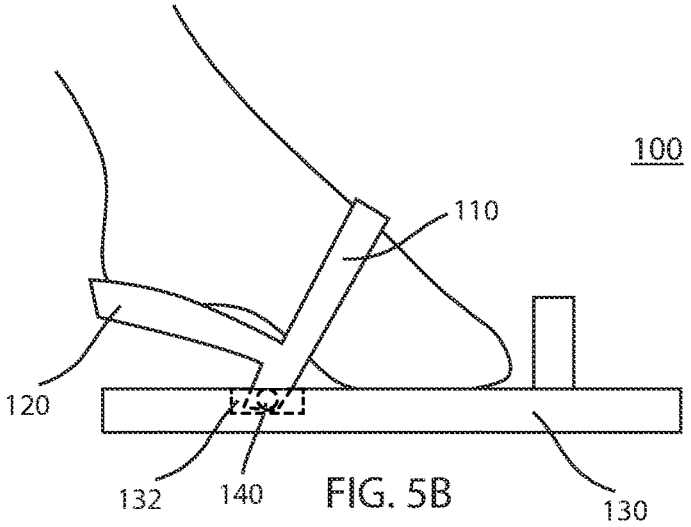
Figure 5C:
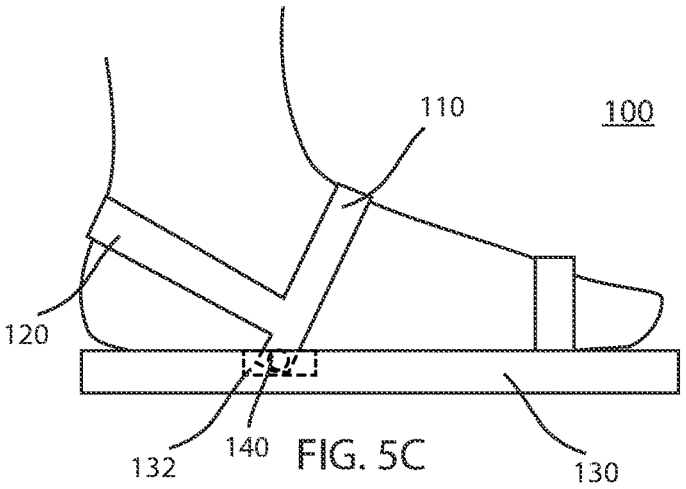

However, in connection with any of the foregoing embodiments, and with particular reference to FIGS. 5A-5C, a forward strap 110 and a rearward strap 120 need not terminate at, or otherwise overlap or encompass, an axis of rotation 140. That is, a strap intersection can comprise a strap extension, the strap extension forming a Y shape together with the strap intersection, and the bottom of the Y shape terminating at, or otherwise overlapping or encompassing, an axis of rotation 140. In such embodiments, the forward strap 110 and/or the rearward strap 120 are configured to pivot relative to each other about an axis distinct from the axis about which the forward strap 110 and/or the rearward strap 120 are configured to rotate relative to the rapid-entry shoe 100 (e.g., a sole portion 130 of the rapid-entry shoe 100).

In this regard, in example embodiments of the present disclosure, an example strap intersection can be partially or exclusively below an upper surface of the sole portion. However, in other example embodiments, an example strap intersection can be partially or exclusively above an upper surface of the sole portion.

With further reference to FIGS. 5A-5C, an embodiment having a strap intersection partially or exclusively above an upper surface of the sole portion can comprise any of the structures above (e.g., resilient member, resilient material, living hinge) such that the forward strap 110 and the rearward strap 120 are configured to pivot relative to the other. Similarly, a strap having a strap intersection partially or exclusively above an upper surface of the sole portion can be coupled to an upper.

In example embodiments, as alluded to above, the forward strap 110 and the rearward strap 120 are further configured to rotate relative to the rapid-entry shoe 100 (e.g., a sole portion 130 of the rapid-entry shoe 100) about an axis of rotation 140 (e.g., at a pin member). In this regard, in example embodiments of the present disclosure, the axis of rotation 140 is partially or exclusively below an upper surface of the sole portion 130 (e.g., through a rear portion of the sole portion 130). In other example embodiments, the axis of rotation 140 is partially or exclusively above an upper surface of the sole portion 130 (e.g., above a rear portion of the sole portion 130).

Notwithstanding some of the drawings, and with continued reference to FIGS. 5A-5C, any strap intersection and an end of any strap or strap extension can be coupled into a recess 132 within an upper surface of the sole portion 130 (e.g., so as to not be visible), the recess 132 configured to permit relative movement of the straps.

With reference to FIGS. 6A and 6B, one or both of a forward strap 110 and a rearward strap 120 of a rapid-entry shoe 100 can be rotated rearward beyond the end of the sole portion 130 to surround the sole portion 130 (e.g., for storage, when not in use). Thus, the radius of a curve defined by a forward strap 110 and/or a rearward strap 120 can be greater than the distance from the end of the sole portion 130 to the axis of rotation 140.

Figure 7A:
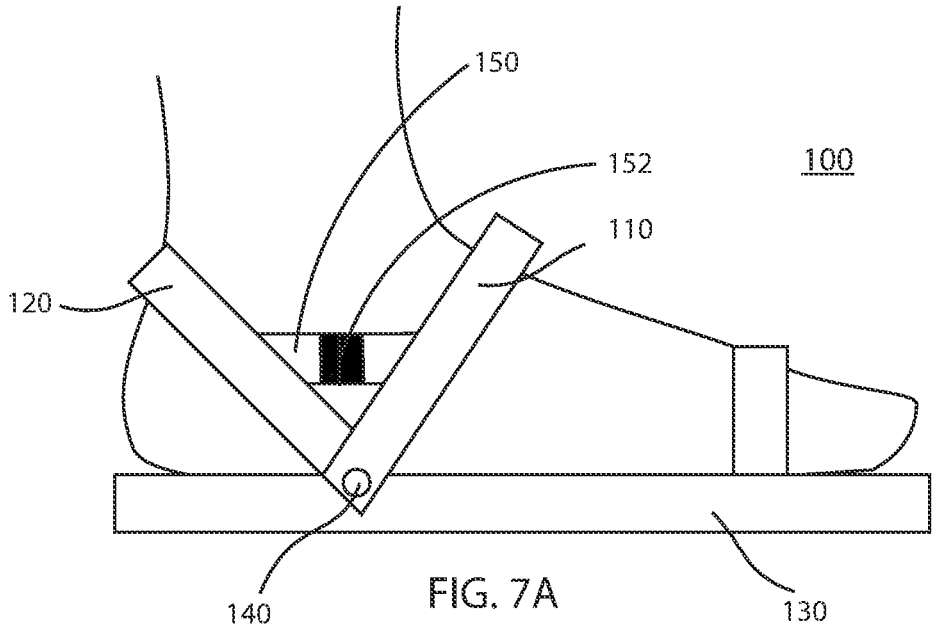
FIGS. 7A-7C illustrate detachment of a resilient member of a rapid-entry shoe, in accordance with an example embodiment.
Figure 7B:
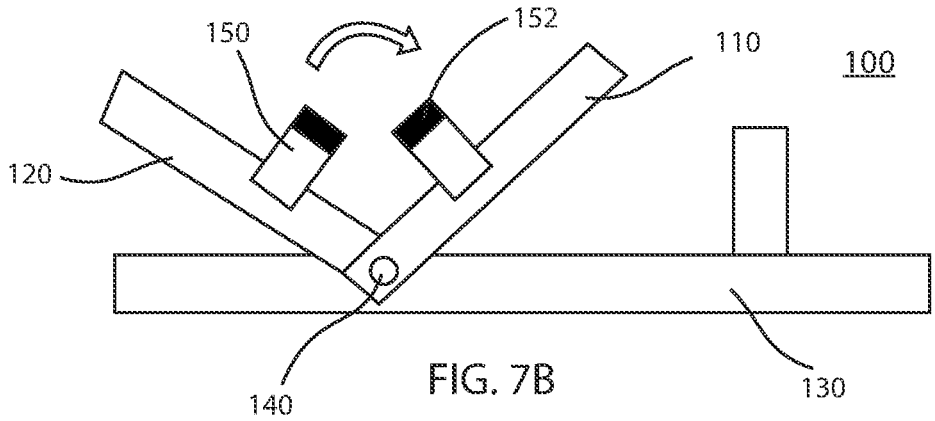
Figure 7C:
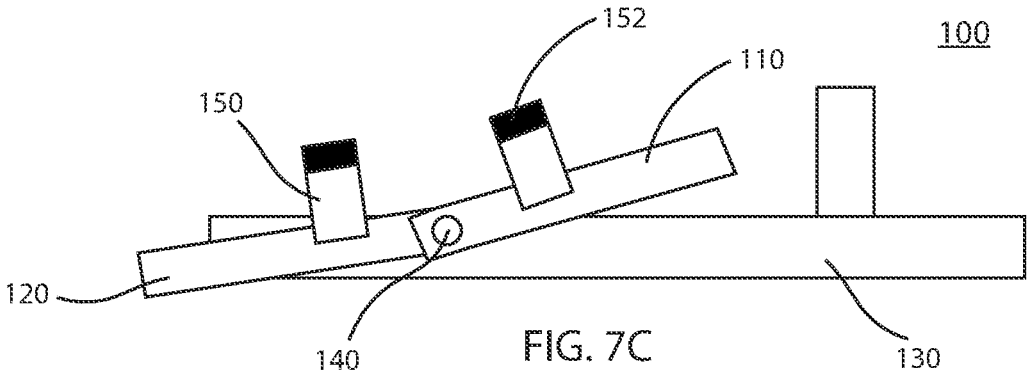

A resilient member 150 can be detachable from one or both of the forward strap 110 and the rearward strap 120. Alternatively, or additionally, and with particular reference to FIGS. 7A-7C, a resilient member 150 of a rapid-entry shoe 100 can be detachable between its ends, for example, at a coupling 152, which may comprise a magnet, buckle, ratchet, hook and loop fastener, etc. In such embodiments, a rearward strap 120 can be rotated rearward, as discussed above, and/or a forward strap 110 can be rotated forward.

Figure 8A:
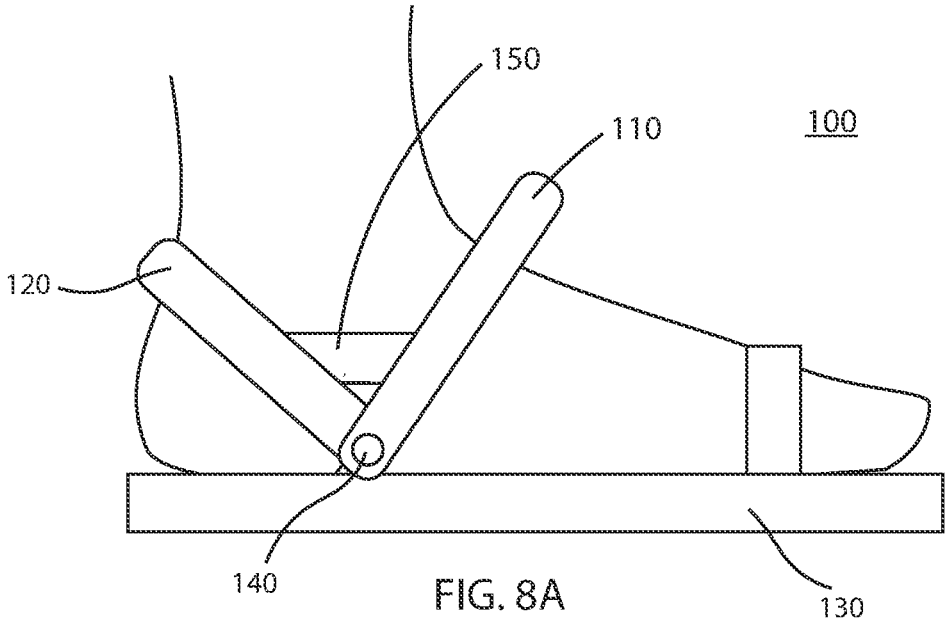
FIGS. 8A and 8B illustrate a forward strap and a rearward strap configured to be bistable, in accordance with an example embodiment.
Figure 8B:
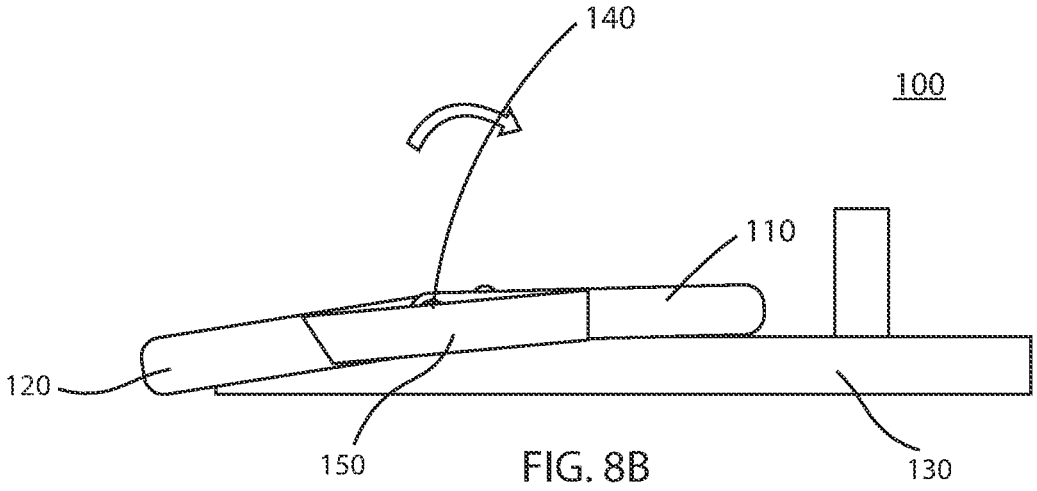
Figure 9A:
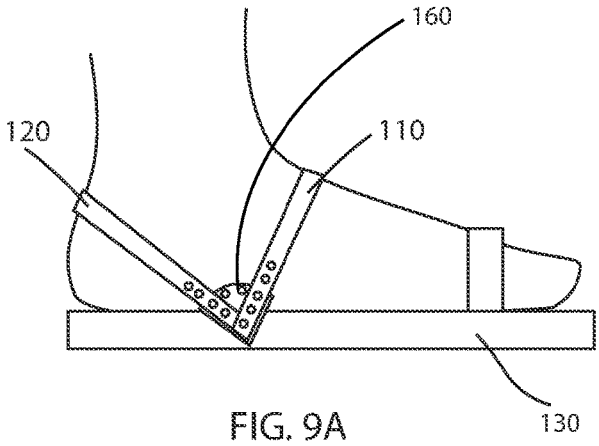
FIGS. 9A-9D illustrate a rapid-entry shoe comprising an adjustment bracket, in accordance with an example embodiment.
Figure 9B:
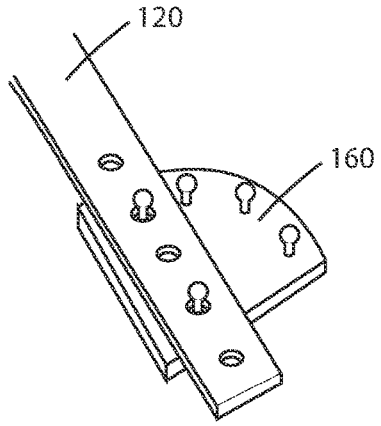
Figure 9C:
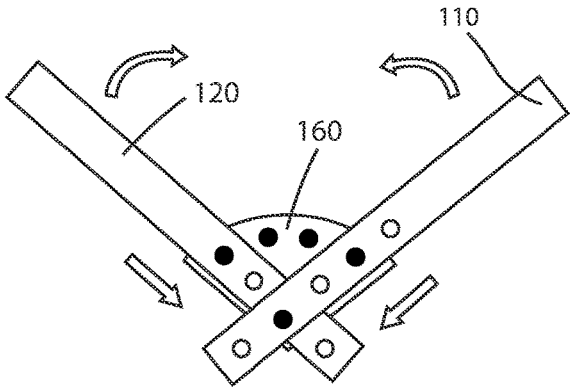
Figure 9D:
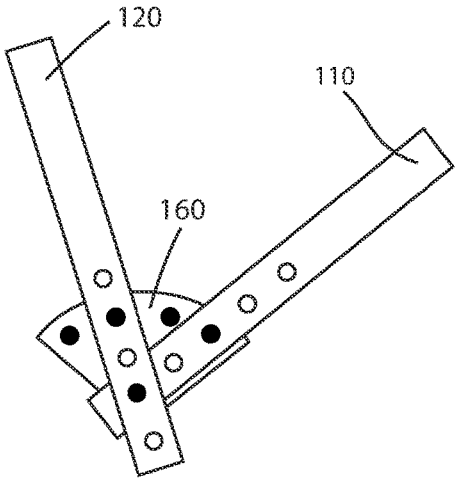

With reference now to FIGS. 8A and 8B, a forward strap 110 and a rearward strap 120 of a rapid-entry shoe 100 can be bistable. In this regard, one of a forward strap 110 and a rearward strap 120 can be configured to be folded flat below an axis of rotation 140 so that a resilient member 150 becomes over centered and holds the forward strap 110 and/or the rearward strap 120 down to the sole portion 130.

With reference to FIGS. 9A-9D, a rapid-entry shoe 100 can further comprise an adjustment bracket 160 on one (lateral or medial) or both sides at the axis of rotation or a strap intersection to engage with a sole portion 130 and one or both of a forward strap 110 and a rearward strap 120. In example embodiments, an adjustment bracket 160 comprises a pie or triangle shape and has a plurality of pegs along its arc and/or a side. In example embodiments, selective engagement between the adjustment bracket 160 (e.g., pegs extending therefrom) and one or both of a forward strap 110 and a rearward strap 120 (e.g., holes extending there through) can provide for strap length and/or angle adjustability. While an adjustment bracket 160 comprising pegs and holes is illustrated, other adjustment brackets are contemplated, for example, comprising one or more of a magnet, buckle, ratchet, hook and loop fastener, etc.

It will be apparent to those skilled in the art that various modifications and variations can be made in the present disclosure without departing from the spirit or scope of the disclosure. Thus, it is intended that the embodiments described herein cover the modifications and variations of this disclosure provided they come within the scope of the appended claims and their equivalents.

Numerous characteristics and advantages have been set forth in the preceding description, including various alternatives together with details of the structure and function of the devices and/or methods. The disclosure is intended as illustrative only and as such is not intended to be exhaustive. It will be evident to those skilled in the art that various modifications can be made, especially in matters of structure, materials, elements, components, shape, size and arrangement of parts including combinations within the principles of the invention, to the full extent indicated by the broad, general meaning of the terms in which the appended claims are expressed. To the extent that these various modifications do not depart from the spirit and scope of the appended claims, they are intended to be encompassed therein.

We claim:

1. A rapid-entry shoe having a forward strap, a rearward strap and a sole portion;

wherein the forward strap is continuous with the rearward strap on a medial side of the rapid-entry shoe at a medial intersection;

wherein the forward strap is continuous with the rearward strap on a lateral side of the rapid-entry shoe at a lateral intersection;

wherein the forward strap extends forward between the medial intersection and the lateral intersection;

wherein the rearward strap extends rearward between the medial intersection and the lateral intersection;

wherein the forward strap and the rearward strap are configured to resiliently pivot relative to the other from the medial intersection or the lateral intersection;

wherein the forward strap and the rearward strap are a unitary structure formed of a single continuous piece and comprised of a resilient material; and wherein the forward strap and the rearward strap are configured to rotate relative to the rapid-entry shoe about an axis of rotation.

2. The rapid-entry shoe of claim 1, wherein the forward strap and the rearward strap are a unitary structure comprising a living hinge.

3. The rapid-entry shoe of claim 1, wherein an upper of the rapid-entry shoe is coupled to the forward strap or the rearward strap.

4. The rapid-entry shoe of claim 1, wherein the medial intersection and the lateral intersection are below an upper surface of the sole portion.

5. The rapid-entry shoe of claim 1, wherein the medial intersection and the lateral intersection are above an upper surface of the sole portion.

6. The rapid-entry shoe of claim 1, wherein the axis of rotation is below an upper surface of the sole portion.

7. The rapid-entry shoe of claim 1, wherein the axis of rotation is above an upper surface of the sole portion.

8. A rapid-entry shoe having a forward strap, a rearward strap and a sole portion;

wherein the forward strap is continuous with the rearward strap on a medial side of the rapid-entry shoe at a medial intersection;

wherein the forward strap is continuous with the rearward strap on a lateral side of the rapid-entry shoe at a lateral intersection;

wherein the forward strap extends forward between the medial intersection and the lateral intersection;

wherein the rearward strap extends rearward between the medial intersection and the lateral intersection;

wherein the forward strap and the rearward strap are a unitary structure formed of a single continuous piece and comprised of a resilient material; and wherein the rapid-entry shoe is biased from an open configuration toward a closed configuration, the forward strap and the rearward strap being generally further apart from one another when the rapid-entry shoe is in the open configuration to facilitate reception of a foot of an individual donning the rapid-entry shoe.

9. The rapid-entry shoe of claim 8, wherein the forward strap and the rearward strap are a unitary structure comprising a living hinge.

10. The rapid-entry shoe of claim 8, wherein an upper of the rapid-entry shoe is coupled to the forward strap or the rearward strap.

11. The rapid-entry shoe of claim 8, wherein the medial intersection and the lateral intersection are below an upper surface of the sole portion.

12. The rapid-entry shoe of claim 8, wherein the medial intersection and the lateral intersection are above an upper surface of the sole portion.

13. The rapid-entry shoe of claim 8, wherein the forward strap and the rearward strap are configured to resiliently pivot relative to the other from the medial intersection or the lateral intersection.

14. The rapid-entry shoe of claim 8, wherein the forward strap and the rearward strap are configured to rotate relative to the rapid-entry shoe about an axis of rotation.

15. The rapid-entry shoe of claim 14, wherein the axis of rotation is below an upper surface of the sole portion.

16. The rapid-entry shoe of claim 14, wherein the axis of rotation is above an upper surface of the sole portion.

* * * * *